US008973226B2

(12) United States Patent
Schwab

(10) Patent No.: US 8,973,226 B2
(45) **Date of Patent: *Mar. 10, 2015**

(54) BURIAL VAULT SYSTEM AND METHOD

(71) Applicant: Polyguard & Co., LLC, Afron, WY (US)

(72) Inventor: Marvin Lee Schwab, Afton, WY (US)

(73) Assignee: Polyguard & Co., LLC, Afton, WY (US)

( * ) Notice: Subject to any disclaimer, the term of this patent is extended or adjusted under 35 U.S.C. 154(b) by 10 days.

This patent is subject to a terminal disclaimer.

(21) Appl. No.: 14/461,714

(22) Filed: Aug. 18, 2014

(65) Prior Publication Data

US 2014/0352121 A1 Dec. 4, 2014

Related U.S. Application Data

(63) Continuation of application No. 14/168,505, filed on Jan. 30, 2014, now Pat. No. 8,881,351.

(60) Provisional application No. 61/849,606, filed on Jan. 30, 2013.

(51) Int. Cl.

| | |
|---|---|
| ***A61G 17/00*** | (2006.01) |
| ***A61G 17/007*** | (2006.01) |
| ***A61G 17/02*** | (2006.01) |

(52) U.S. Cl.

CPC ..... *A61G 17/007* (2013.01); *A61G 17/02* (2013.01)

USPC ..... 27/35; 52/135; 52/141; 27/7

(58) Field of Classification Search

USPC ..... 27/2, 3, 7, 17, 35; 52/128, 135, 52/139–141; 264/135, 256

See application file for complete search history.

(56) References Cited

U.S. PATENT DOCUMENTS

| | | | | |
|---|---|---|---|---|
| 1,969,410 | A * | 8/1934 | McNabb et al. | 52/137 |
| 2,265,876 | A * | 12/1941 | Sleichter | 52/135 |
| 2,289,435 | A * | 7/1942 | Kirby | 52/135 |
| 3,439,461 | A * | 4/1969 | Chandler et al. | 52/139 |
| 3,787,545 | A * | 1/1974 | Chandler et al. | 264/135 |
| 3,839,768 | A * | 10/1974 | McQuestion | 27/35 |
| 4,060,581 | A | 11/1977 | Darby et al. | |
| 4,128,981 | A * | 12/1978 | Juba | 52/309.3 |
| 4,476,657 | A * | 10/1984 | Juba et al. | 52/139 |
| 5,611,125 | A | 3/1997 | Williams et al. | |
| 5,722,133 | A * | 3/1998 | Farris et al. | 27/17 |
| 6,170,201 | B1 * | 1/2001 | Mason et al. | 52/136 |
| 6,453,626 | B1 * | 9/2002 | Weilein et al. | 52/139 |

* cited by examiner

*Primary Examiner* — William Miller

(74) *Attorney, Agent, or Firm* — Andrew F. Young, Esq.; Lackenbach Siegel, LLP

(57) ABSTRACT

A concrete burial vault system having a layered construction of castable material encased in an inner liner and an outer casing of a thermoplastic polymer such as polypropylene utilizes the liner and casing as a mold for the concrete and enables monolithic molds with self-supporting securing tabs. This system allows the liner and casing to be manufactured at a central location and then transported to a plurality of use locations to be filled with concrete. The manufacturing method supports the system and provides an assembly advantage.

15 Claims, 7 Drawing Sheets

BURIAL VAULT SYSTEM AND METHOD

CROSS REFERENCE TO RELATED APPLICATIONS

This application relates to, and is a continuation of, U.S. Ser. No. 14/168,505 filed Jan. 30, 2014, which in turn claims priority from U.S. Prov. Ser. No. 61/849,606 filed Jan. 30, 2013, the entire contents of each of which are incorporated herein by reference

BACKGROUND OF THE INVENTION

1. Field of the Invention

The present invention relates to a burial vault system and a method for preparing the same. More particularly, the present invention provides an improve burial vault system, kit, and assembly with improved manufacturing reliability herein a vault structure has a layered construction with a ceramic casting encased by an interior and exterior thermoplastic member as a mold. The present invention also provides a manufacturing method for the vaults wherein an interior and exterior members are initially manufactured at a primary location, distributed to a completion location and the assembly completed therein using supportive devices.

2. Description of the Related Art

The vast majority of cemeteries in the United States require use of a grave liner or burial vault when interring casketed remains. Grave liners and burial vaults are box-like containers in which casketed remains are placed at the time of burial. The purpose of a grave liner is to prevent surface subsidence as the casket disintegrates as well as to protect the casket from future intrusive disturbance that might occur if another grave is dug adjacent the first. A burial vault is similar in function and purpose to a grave liner but a vault also provides protection to the casket from ground water and other sources of moisture.

Burial vaults are usually constructed of concrete and are manufactured by pouring concrete into a metal mold. A plastic liner, typically of polystyrene, is often placed over the mold before the concrete is poured to provide a water barrier on the inside of the vault. The exterior vault surfaces are frequently painted or textured to obtain a more pleasing product and to add value to the product. Additional decorative appeal is frequently obtained through use of metal or plastic cladding or highlights.

Exemplary patents showing the state of the art include U.S. Pat. No. 4,060,581 (Darby) which describes a method of making a plastic-concrete composite burial vault utilizing a thermosetting resin to form an interior lining for the vault. Another patent, U.S. Pat. No. 5,611,125 (Williams), discloses a burial vault having wall members of plastic enclosing a chamber which is filled with concrete. Yet another patent, U.S. Pat. No. 6,282,763 (Goria), describes a burial vault in which the lid, base, and wall members are formed as chambers which are then filled with a flowable structural material to form rigid composite. The entire contents of each of which are incorporated herein by reference.

Accordingly, there is a need for an improved burial vault system, method for assembly and use, and the improvements thereof.

ASPECTS AND SUMMARY OF THE INVENTION

In response, a burial vault system having a layered construction of castable material encased in an inner liner and an outer casing of a thermoplastic polymer such as polypropylene utilizes the liner and casing as a mold for the concrete and enables monolithic molds with self-supporting securing tabs. This system allows the liner and casing to be manufactured at a central location and then transported to a plurality of use locations to be filled with concrete. The manufacturing method supports the system and provides an assembly advantage.

In one aspect of the present invention, a burial vault is formed as a box and a lid from concrete that is encased by an interior and an exterior thermoplastic member which form a mold for the concrete and, after the concrete has cured, becoming integral parts of the finished burial vault. The thermoplastic members may comprise polypropylene or high density polyethylene or styrene, or other suitable plastic material, and may be constructed by vacuum forming or injection molding. Manufacture of the thermoplastic members at a central location and transporting those members to a plurality of use locations for filling with concrete introduces significant savings in transportation cost as well as avoiding the need and the cost for expensive metal molds. While this invention does not place a restriction on the thickness of the members, thicknesses preferably are within 0.100 and 0.350 inches, and more preferably between 0.200 and 0.300 inches, with the most preferred thickness being 0.250 inches for enhanced density and durability.

Another aspect of the present invention is that the interior base construction of the burial vault provides for integrally molded support members for a supported casket whereby such a casket may be readily released from any support structures during a burial process without necessary rocking of the casket itself.

Another aspect of the present invention is that the top lid and base have an integrally formed and supported sealing lip member enabling an airtight seal during use and after assembly.

Another aspect of the present invention is that the interior base member is particularly formed with supporting and rigidizing finger channels enabling rapid integration while co-support with concrete formed within the base member. The channel embers include an upright arrangement but may be adapted to any suitably arrangement to support the sealing lip portion and to aid the casting-filling process during assembly thereto.

Another aspect of the present invention is that the lid member includes integrated support structures for transport during use, and concealment following use in the form of threaded support members.

Another aspect of the proposed invention includes the formation of reinforcement support and location tabs on the pre-formed lid and base members. The preformed reinforcement support and location tabs allow improved placement, and suspension within a casting mixture of reinforcing rods of various dimensions and lengths to prohibit cracking of the cast monolithic bodies.

In another aspect of the proposed invention it will be understood that the thickness/height of the vault lid:base member ratio is within the range of 65-50:50-40 so that the arc shape of the vault lid supports and transfers substantial weight, much more weight than conventional burial vaults where the lid is less of a support member (e.g., a cover of limited thickness and height). This provides an additional enhancement for ease of transport, on-site assembly, and combination during the final preparations with remains.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
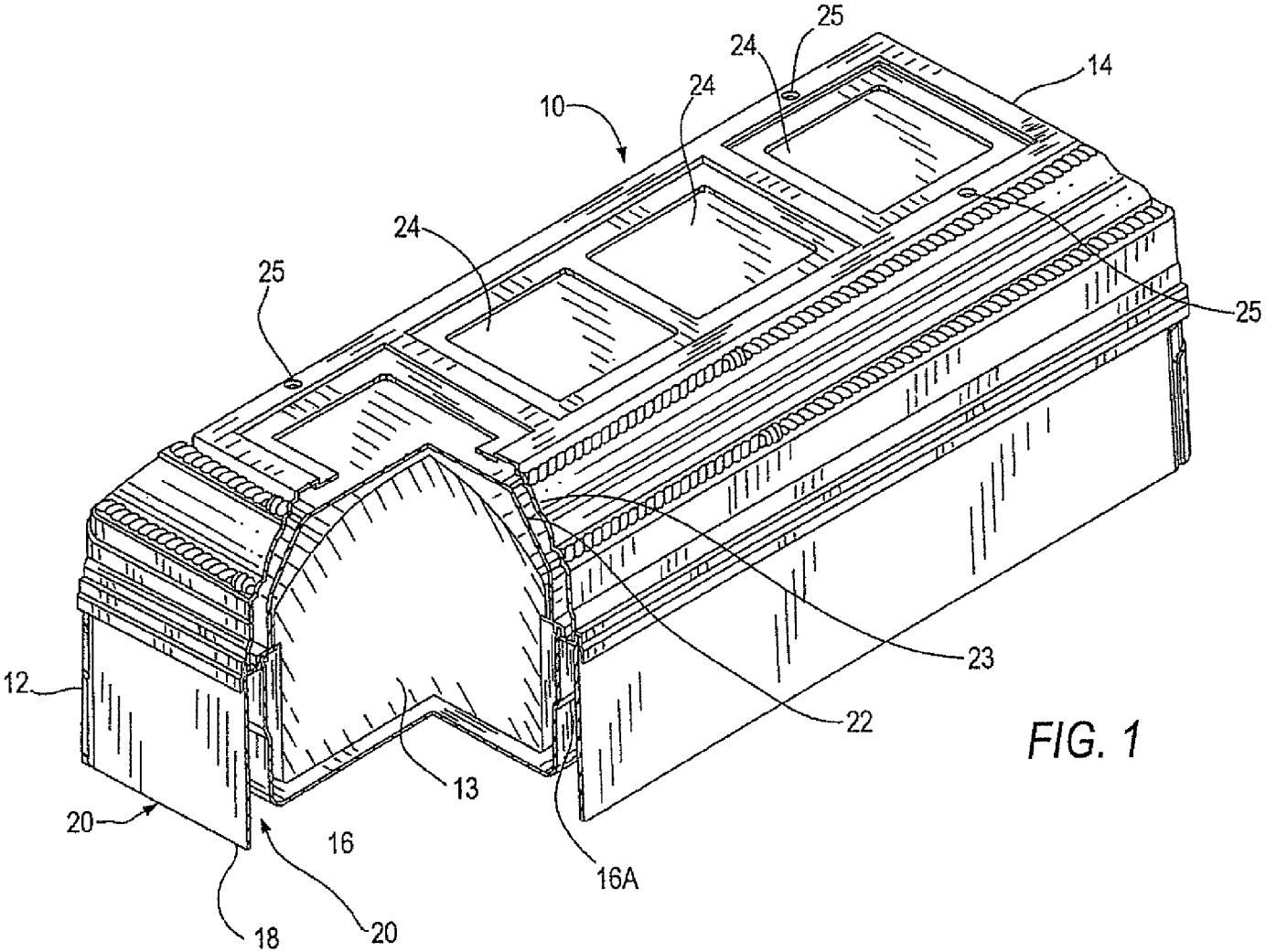
FIG. 1 is a perspective illustrative view of one aspect of the burial vault system according to the present invention.

Reference will now be made in detail to embodiments of the invention. Wherever possible, same or similar reference numerals are used in the drawings and the description to refer to the same or like parts or steps. The drawings are in simplified faun and are not to precise scale. The word 'couple', 'connect' and similar terms do not necessarily denote direct and immediate connections, but also include connections through intermediate elements or devices. For purposes of convenience and clarity only, directional (up/down, etc.) or motional (forward/back, etc.) and positional (top/bottom etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

As used throughout, ranges are used as a shorthand, for describing each and every value that is within the range. Any value within the range, and adjacent thereto, can be selected as the terminus of the range. In addition, all references cited herein are hereby incorporated by reference in their entireties. In the event of a conflict with a definition of the present disclosure and that of a cited reference, the present disclosure controls.

Various operations may be described as multiple discrete operations in turn, in a manner that may be helpful in understanding embodiments of the present invention; however, the order of description should not be construed to imply that these operations are order dependent.

The market for burial vaults is geographically fragmented. Vault manufacturers sell primarily to funeral directors and ordinarily provide a range of services along with the vault itself. Those services typically include delivery of the vault to the cemetery or other place of burial and placement of the vault into the grave. That requires use of a hoist truck as a concrete vault weighs about 2,000 pounds, or more. After the vault is in place within the grave the vault crew makes other preparations for the committal service including placement of a casket lowering device over the grave. After conclusion of the committal service, the vault crew lowers the casket into the vault and then uses the boom truck to place the lid on the vault.

This commercial tie between sale of the vault itself and the services associated with the sale makes it difficult for an established, or new, manufacturer to expand into a new geographic area. The cost of transporting the heavy and bulky vaults from the manufacturing location to many different customer locations also serves to limit the geographic area that can be efficiently served by a single manufacturing site. This invention defines a manufacturing and marketing approach that avoids the difficulties inherent in the present model.

Turning now to FIG. 1, there is shown an oblique partial sectional view of the burial vault system 10 of this invention. Vault system 10 includes an open topped, box-like lower container or base 12, that is sized to hold a casket 13, and a lid member 14 that fits on top of and seals container 12. The side walls and bottom of container 12 are of uniformly formed layered construction and comprise an inner liner member 16 and an exterior casing 18, defining a region for receiving a concrete fill 20 completely therebetween filling the space between liner 16 and casing 18. An upper lip profile 16A of inner liner member includes a particular profile for sealing (shown later) and also a plurality of rigidizing and flowing finger members (shown later) providing additional support for concrete flowing during filling and for securing vault system 10 thereafter. Lid member 14 is constructed in similar layered fashion with concrete sandwiched between an inner liner 22 and a top panel 23. Panel 23 may include framed window areas 24 for the mounting of photographs or other memorabilia or indicia.

Also noted in FIG. 1 are a series of openings 25, in top panel 23 for the positioning and securement of threaded fasteners (I-bolts/eye-bolts) for use in lifting lid member 14 following filling the inner cavity with concrete and for other positioning needs. After positioning, it will be understood, that the threaded fasteners may be removed from openings 25, and a decorative cover cap positioned to enhance ornamental appearance therein.

In constructing the vault, the inner liner and the exterior casing members are formed of a thermoplastic polymer, preferably polypropylene or high density polyethylene. The members can be produced by injection molding or by thermoforming and preferably are designed to nest, one inside another so as to allow efficient use of transport and warehouse space. These features of the invention allow a large geographic area to be served by a single fabricator of the inner liner and exterior casing members through savings in transportation costs alone. It also allows for competition within established marketing areas of conventional concrete burial vaults by utilizing relationships that currently exist between vault manufacturers and funeral homes.

It can now be appreciated that this invention offers significant advantages in vault construction and servicing as compared to the established business practices of vault manufacturers.

Figure 2:
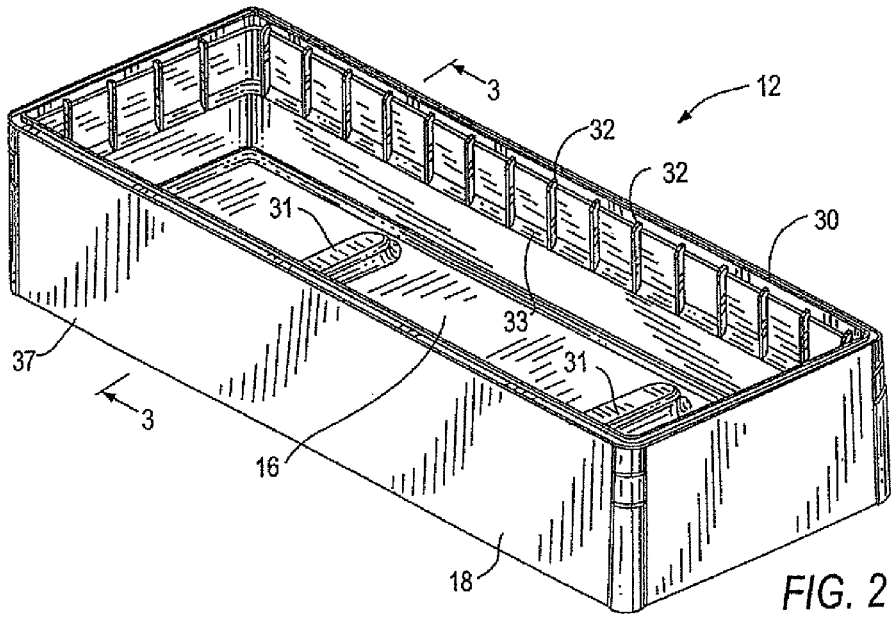
FIG. 2 is a perspective view of a bottom member.
Figure 3:
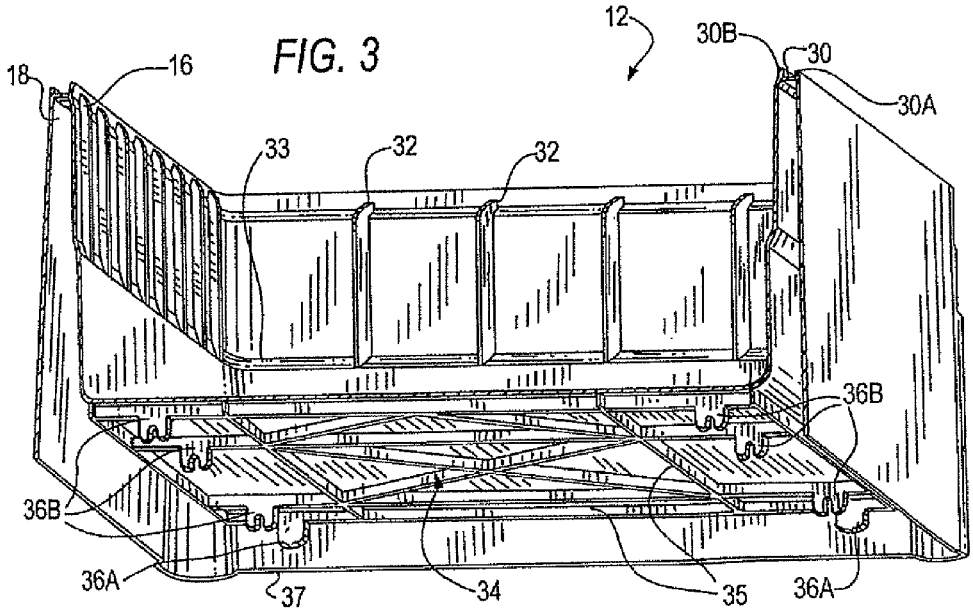
FIG. 3 is a partial sectional perspective view along line 3-3 in FIG. 2, noting the inner and bottom construction forms of the bottom member.

Referring additionally now to FIGS. 2 and 3 wherein lower casket or base 12, provided with an inner liner member 16 and an outer liner member 18 are noted as integrally formed with a top-lip profile 30 including a protruding inner lip 30B and a flat support lip 30A. Also noted therein on the bottom floor portion of inner liner member 16 are shown a plurality of integrally formed support extensions 31 enabling direct support of casket member 13 and the removal of casket support straps (not shown). Also formed along the inner lip profile 30 are a plurality of rigid extending finger formations 32 and a recessed slope 33. Finger formations 32 ease the flow of castable material during filling formation into the narrower lip profile 30 to ensure a full fill process, and to provide an ornamental feature therewith. Additionally, the recessed slope 33 proves additional support along the wall portions. It will be understood that a plurality of alternative formations 32 may be used (not shown, but could be box-form, longitudinal geometric form, with differing positions and slopes etc.) without departing from the scope and spirit of the functional details herewith. Additionally, on a bottom surface 34 of the inner member 16 a plurality of monolithic molded support beams 35 are formed to provide a rigid support to ensure a flat formed bottom during casting. Additionally, included are a plurality of monolithically molded support tabs having male forms 36A (guides) and female forms 36B (U-shaped) to receive reinforcing bar members 56 prior to casting. Support tabs 36A, 36B are positioned projecting below the bottom of inner member 16 but recessed below the outermost rim 37 of outer liner member 18. In use the reinforcing member 56 may extend the length and width of the bottom of the base to reinforce the concrete and provide secure support for the walls. During casting, concrete flows around the reinforcing members 56 (suspended by the support tabs) and enters the side walls smoothly and then descends (the form is inverted) guided by the fingers to the very bottom to provide a continuous filling.

Figure 4:
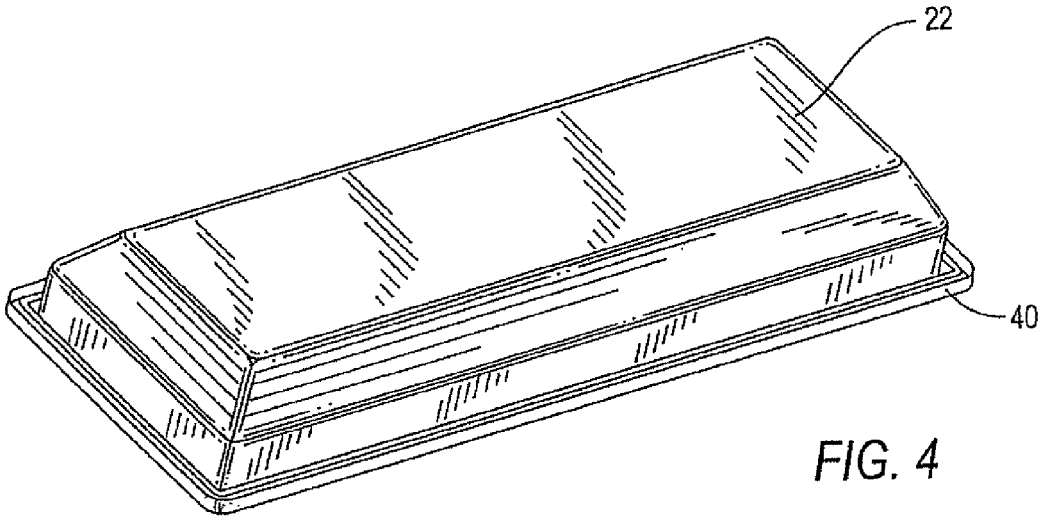
FIGS. 4 and 5 show the inner panel of the lid member prior to assembly and casting.
Figure 5:
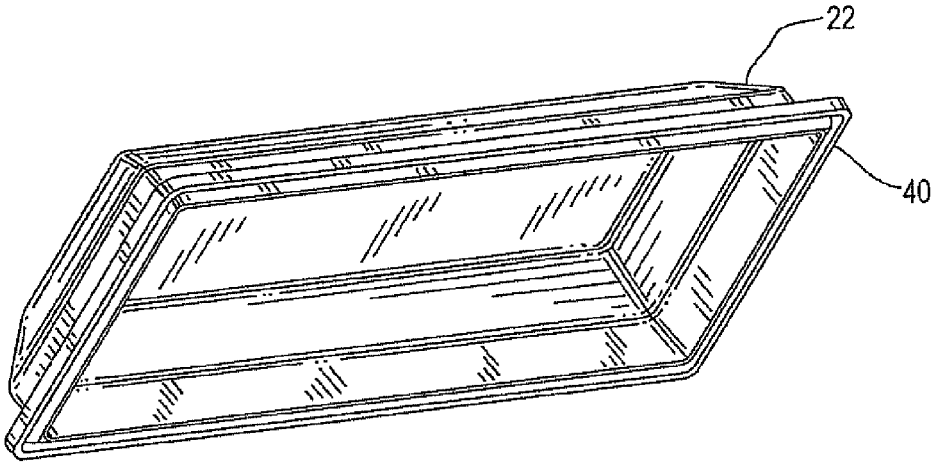
Figure 6:
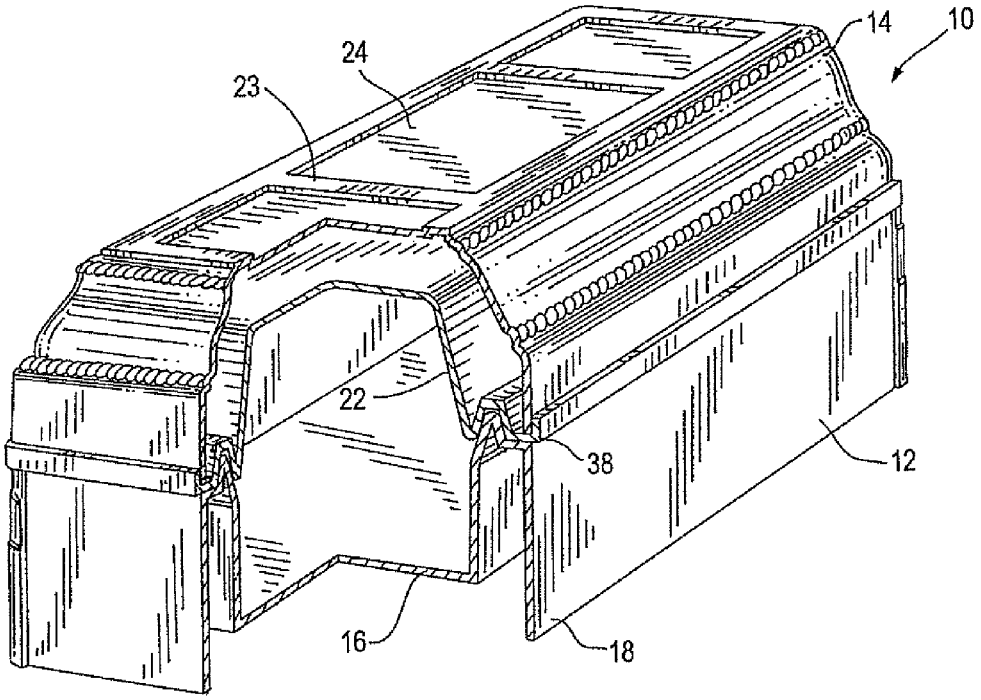
FIG. 6 is a partially cut away view of the burial vault 10, as in FIG. 1, noting the inner seam of the lid member.

Referring now to FIGS. 4, 5 and 6, the lid 14 is shown in the inner liner member 22 in a form separated from the outer top panel 23 (not shown) and prior to casting. During assembly, inner liner member 22 is bonded to top panel member 23 along seam 38 formed by using a poly-suitable adhesive in the trade to bond polypropylene or other thermoplastics such as the type commonly known by the name LiquidNail®. As is recognized the inner liner member 22 and outer top panel 23 may be transported in a pre-bonded condition for space savings, and assembled on site using a jig (not shown) to support the members therebetween, and to form a cavity for receiving concrete 20 as shown in FIG. 6. While inner liner member 22 is shown with the profile noted and preferred in FIGS. 4 and 5, nothing herein shall so limit the invention. What is noted is that the above-noted ratio (lid:base) is a wide range, including (as shown in FIG. 6) approximately 50lid:50base. In this manner the outer lip profile 30 of the bottom unit liner 12 is received within a female outer lip profile 40 formed on the outer rim portion of inner liner member 22. It will also be noted that inner liner member 22 may be formed of an ABS thermoplastic sheet or from other plastic materials noted herein. It is preferred for all plastic members to be of polypropylene or high density polyethylene as this provides a substantial weather-sealing advantage and stability during casting.

Figure 7:
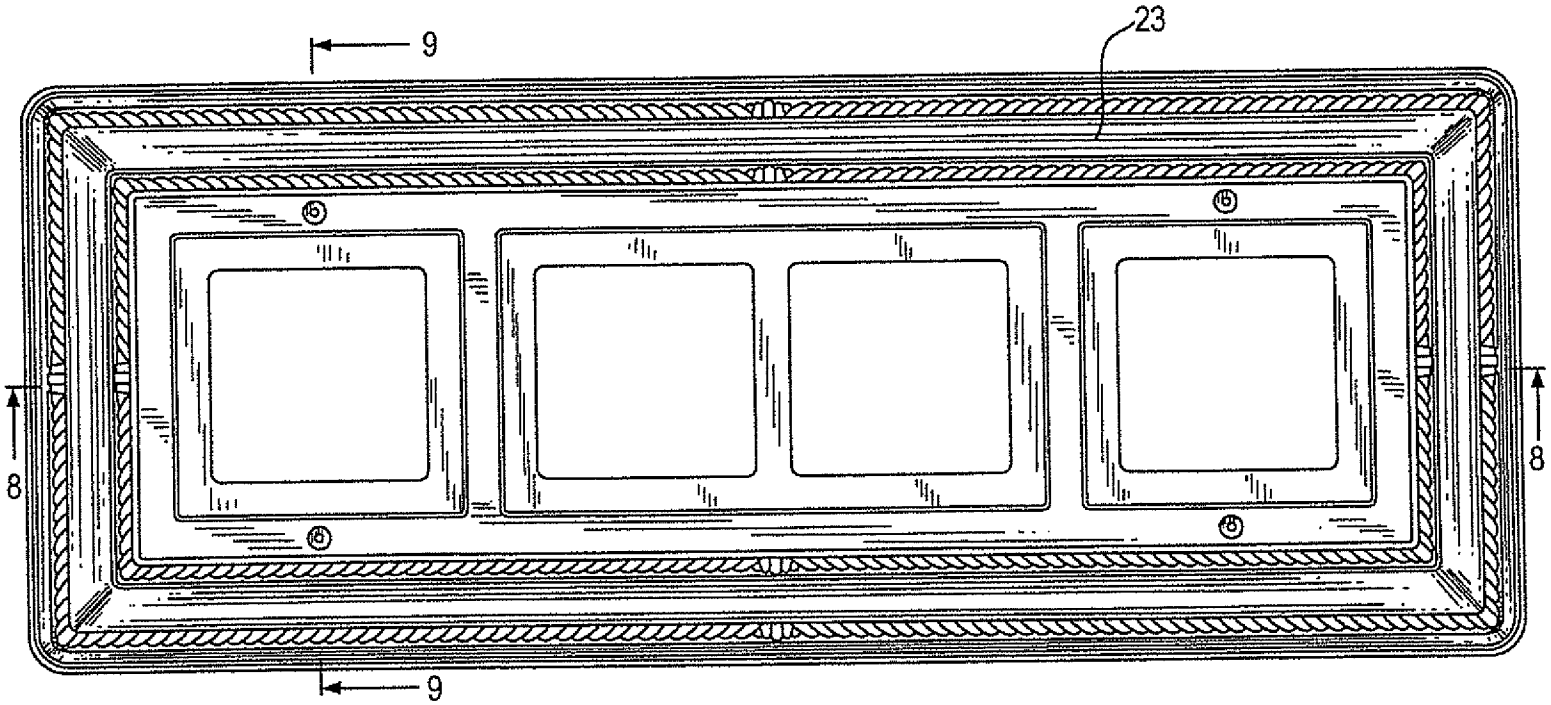
FIGS. 7, 8, and 9 provide additional detail of the outer top panel of the lid.
Figure 8:
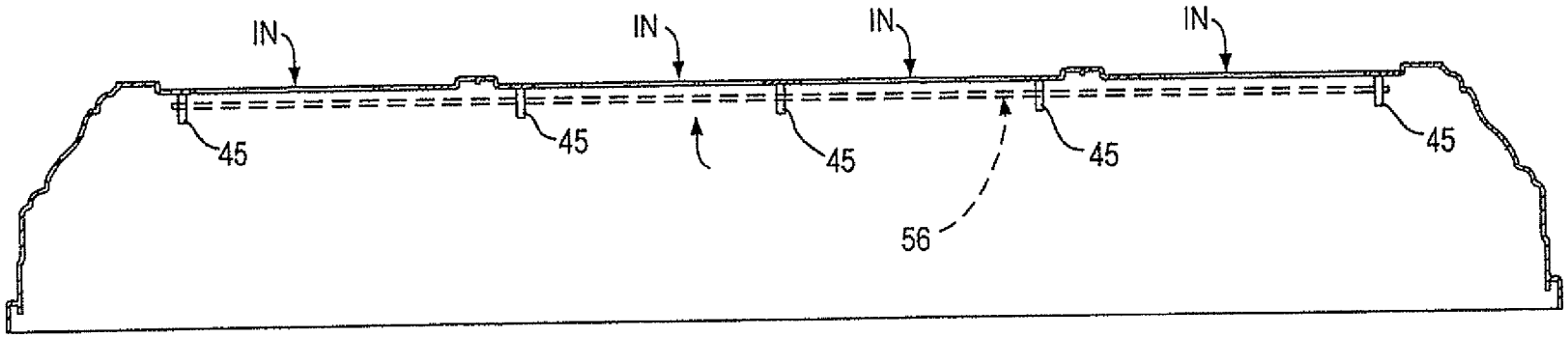
Figure 9:
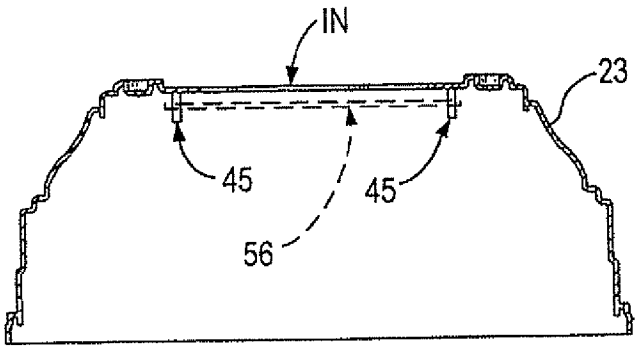

Referring now to FIGS. 7, 8, and 9 the outer top panel 24 of the lid 14 is provided in detail from a top, and sectional views (Section views FIGS. 8 and 9 of FIG. 7 along section lines 8-8 and 9-9 respectively. As will be noted, on the underside of the outer top panel 23, between the decorative cut outs 24, 24, etc. there are reinforcing protuberances 45 between respective openings 24. Protuberances 45 are monolithically molded with outer top panel 23 and optionally include male guides (for guiding reinforcing bar stock), female guides (for retaining reinforcing bar stock), or closed supports (allowing a user to drill there through to inset a custom reinforcing arrangement. Arrows illustrate the openings for casting into the as-assembled lid 14 following the joining at the seam 38 (FIG. 46).

Now discussed is the method of assembly. While steps may be varied, those of skill in the art will recognize and understand the impact of the assembly steps herewith.

Preparing the lid 14 includes the steps of inverting the outer lid 23 to expose the underside support reinforcing support members 45 (see FIGS. 8 and 9). Reinforcing rods 56 are secured in respective reinforcing support members 45 to provide a rigidizing support proximate the openings 24 during casting. Next a suitable adhesive is applied in the exposed tongue-and-grove slot of the outer lid 23. Next the inner liner 22 is placed into the tong-and-grove forming the secure seam and lip at 40 and integrating the lid 14 (inverted). Next, and optionally, a brad nail gun or other riveting device may be used to additionally secure lid members 22, 23 together about the rim prior to casting.

Figure 10:
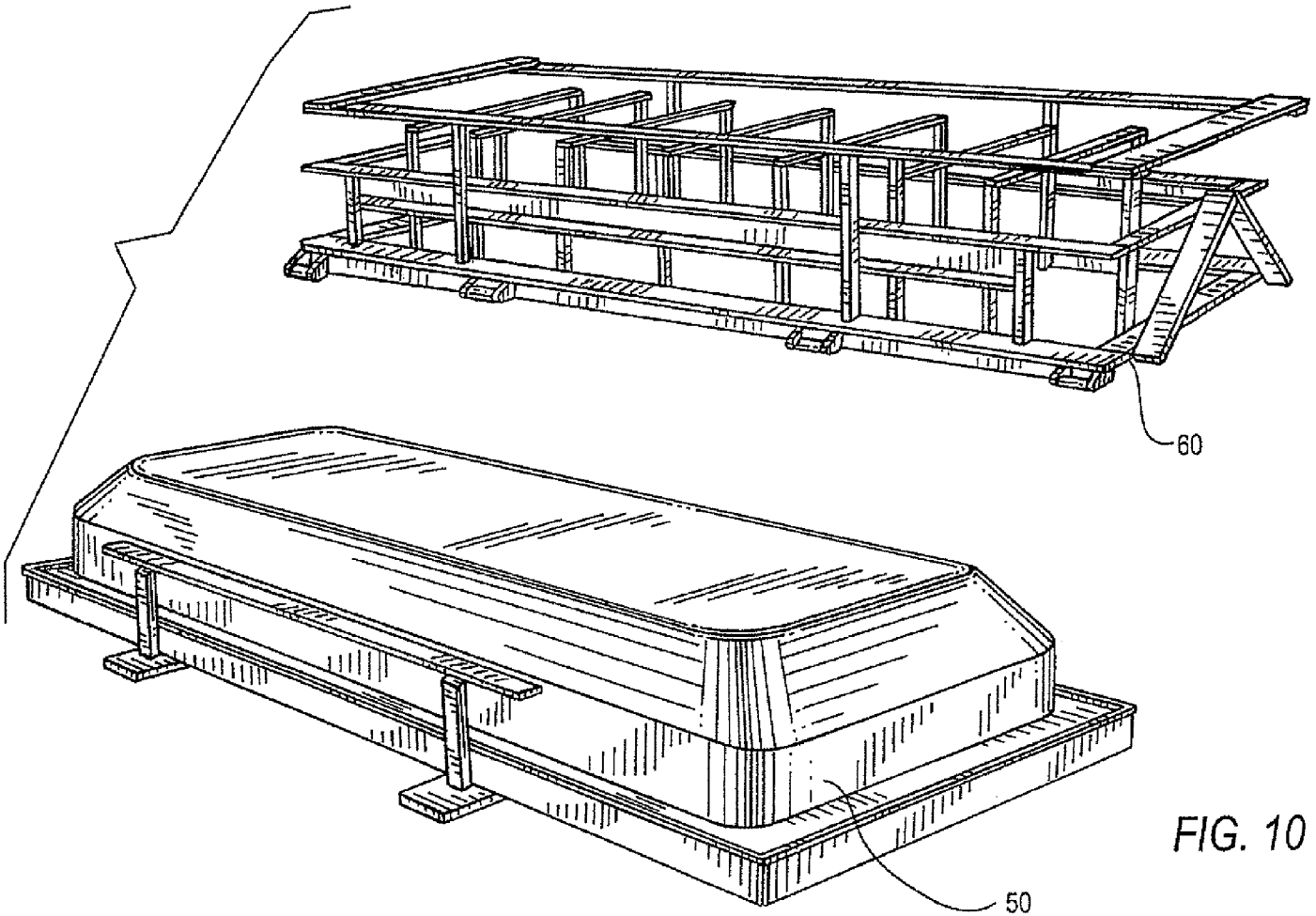
FIG. 10 notes a lid casting support and a base casting support.

Invert (turn right-side-up) lid 14 and place it over a support casting monolith 50 (see FIG. 10, left side). Lid support casting monolith 50 provides inner ruggedizing support to inner lid member 22 during casting to eliminate the risk of distortion during casting. It is noted that lid support casting monolith provides side bracing bars (shown) to prevent outer distortion and to secure lid 14 in place during casting. Next install threaded carry supports (I-bolts) via holes 25 into lid 14, to allow the carrying and transport of lid 14 in a post-cast position. A nut is used to correctly position the height of the bolt and secure in place.

Next the base 12 is prepared by initially inverting and securing appropriate reinforcing bar members into supports 36A, 36B to provide enhanced rigidity. The rigid members 35 provide spacing support for rebar within the casting mix. Next place the base 12 (still inverted) over a base support frame 60 as shown (FIG. 10, right side). Base support 60, shown but not numbered provides interior rigidizing support prior to and during casting and also provides a pivot mechanism (shown) enabling a user to rotate upright the post-cast base 12 to a right-side-up position. The base support also has side bracing support on all sides to prevent lateral distortion during casting. End supports (not shown) are positioned on the base support to allow lifting by lifting straps post cast for ease of movement.

Next casting is done on either lid 14 or base 12. In either casting situation, casting material is prepared (see below) and introduced into each position within the various molding forms to provide a continuous seal. Following casting, lid 14 is removed from the casting support and base 12 is inverted and removed from the casting support for the base.

Following the casting of the lid and removal from the casting support, the presentation openings 24, 24 are covered with decorative materials or indicia, and both the lid 14 and the base 12 are cleaned for use.

In one aspect of the present invention, the concrete mix employed during the casting process is selected from a mixture along the following outline:

1600 lb. ¼-⅜ washed pea gravel 1600 lb. washed sand 611 lb Portland 6½ bag or 658 lb. Portland 7 bag As an additional improvement to the proposed mixture, for better flow and faster cure, a conditioner, Polyheed 997® mid-range water reducing admixture (water to desired slump) may be employed at the rate of 15 oz. of water reducer per 100 lb. of Portland Cement (for example: a 6½ bag mix would take 91½ oz. of water reducer). It will be understood by those of skill in the art that the filling composition for the burial vault system is not limited to concrete, or to the particular mixtures discussed herein, but may be any suitable material effective to provide a rigid barrier and support system under the needed conditions. A number of non-concrete based castables may be employed within the scope and spirit of the present invention. For example, known are adhesive based (not lime based) ground mixtures that form rigid strictures typically with a filler material such as sand, dirt, and gravel.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A burial kit system comprising:

a lid member and a base member;

said lid member further including a formed inner lid layer and an outer lid layer and on assembly forming a bounding cavity therebetween and a lid lip section having a lid lip profile;

said lid member shaped on assembly to readily receive an external castable material in said lid member within said inner lid layer and outer lid layer for binding therewith forming a monolithic lid during an assembly of said burial kit system;

said lid member having a cross-sectional shape in arc form and having a first lid total height;

said inner lid layer and said outer lid layer being formed of a thermoplastic;

said base member including a monolithically formed inner wall layer and an outer wall layer forming a bounded cavity therebetween and a base lip section having a base lip profile;

said base member having a cross-sectional U-shape form and having a first base total height;

said lid lip profile having a female receiving shape;

said base lip profile having a male extending shape complementary to said lid lip profile, wherein upon assembly aid lid lip profile and said base lip profile interfit in a sealing manner;

said inner wall layer of said base member further including a plurality of regularly formed projecting finger members proximate said base lip profile, whereby said finger members enable an enhanced formation of said base member;

a plurality of reinforcing protuberances monolithically formed with said outer lid layer and extending inwardly on an inside surface of said outer lid layer shaped for engagement with an external reinforcing member during an assembly therewith; and a plurality of support tabs protruding inwardly on a bottom surface of said inner wall layer of said base for engagement with an external reinforcing member during an assembly therewith.

2. The burial kit system, according to claim 1, further comprising:

a plurality of secure reinforcing members; and selected ones of said reinforcing members and ones of said support tabs engaging respective said reinforcing members during said assembly therewith.

3. The burial kit system, according to claim 1, further comprising:

a lid casting support operatively formed to support said inner lid layer and said outer lid layer during a casting of said lid member.

4. The burial kit system, according to claim 1, further comprising:

a base casting support operatively formed to support said base member during a casting thereof.

5. The burial kit system, according to claim 1, wherein;

upon assembly a ratio of said lid member and said base member relative to a defined total height of said burial system is a lid height:base height ratio within the range of 60-to-40:60-to-40, with the total height being a net sum 100.

6. The burial kit system, according to claim 1, wherein:

said lid height:base height ratio is within the range 55-to-50:55-to-50 with the total height being said net sum 100.

7. The burial kit system, according to claim 1, wherein:

said base layer further comprises at least two integrally formed support members monolithically formed proximate a receiving portion of said inner wall layer, whereby during a use said support members are operative to receive an installed casket and supports may be removed there through without disturbance of said installed casket.

8. The burial kit system, according to claim 1, wherein:

said plurality of finger formations being rigid and monolithically formed with said inner wall layer; and said finger formations at regular intervals reducing a dimension of said bounded cavity between said inner wall layer and said outer wall layer about said bounded cavity therebetween.

9. The burial kit system, according to claim 1, further comprising:

at least one reinforcing member for use during an assembly thereof.

10. The burial kit system, according to claim 1, further comprising:

said castable material formed in one of said lid member and said base member.

11. The burial kit system, according to claim 10, further comprising:

a lid casting support member for supporting said lid member during a casting thereof.

12. A method of assembling a burial kit system, comprising the steps of:

providing a lid member and a base member;

said lid member further including a formed inner lid layer and an outer lid layer and on assembly forming a bounding cavity therebetween and a lid lip section having a lid lip profile;

said lid member shaped on assembly to readily receive an external castable material in said lid member within said inner lid layer and outer lid layer for binding therewith forming a monolithic lid during an assembly of said burial kit system;

said lid member having a cross-sectional shape in arc form and having a first lid total height;

said inner lid layer and said outer lid layer being formed of a thermoplastic;

said base member including a monolithically formed inner wall layer and an outer wall layer forming a bounded cavity therebetween and a base lip section having a base lip profile;

said base member having a cross-sectional U-shape form and having a first base total height;

said lid lip profile having a female receiving shape;

said base lip profile having a male extending shape complementary to said lid lip profile, wherein upon assembly aid lid lip profile and said base lip profile interfit in a sealing manner;

said inner wall layer of said base member further including a plurality of regularly formed projecting finger members proximate said base lip profile, whereby said finger members enable an enhanced formation of said base member;

a plurality of reinforcing protuberances monolithically formed with said outer lid layer and extending inwardly on an inside surface of said outer lid layer shaped for engagement with an external reinforcing member during an assembly therewith; and a plurality of support tabs protruding inwardly on a bottom surface of said inner wall layer of said base for engagement with an external reinforcing member during an assembly therewith.

13. The method of assembling according to claim 12, further comprising the steps of:

providing a lid casting support operatively formed to support said lid member during a casting thereof;

providing at least one reinforcing member for use during an assembly thereof; and assembling said inner lid layer and said outer lid layer on said lid casting support with said at least one reinforcing member.

14. The method of assembling according to claim 13, further comprising the steps of:

providing a base casting support operatively formed to support said base member during a casting thereof; and positioning said base member on said base casting support.

15. The method of assembling according to claim 14, comprising the steps of:

providing a castable material;

forming said castable material in said lid member and said base member;

removing said lid member from said lid casting support and said base member from said base casting support; and assembling said lid member and said base member.

* * * * *